US005398390A

United States Patent [19]

Hede et al.

[11] Patent Number: 5,398,390

[45] Date of Patent: Mar. 21, 1995

[54] FIXING LOOP FOR A CHIN-STRAP OF A SAFETY HELMET

[75] Inventors: Jean M. Hede, La Tronche; Alain Maurice, Gieres, both of France

[73] Assignee: Zedel, Crolles, France

[21] Appl. No.: 53,359

[22] Filed: Apr. 28, 1993

[30] Foreign Application Priority Data

May 4, 1992 [FR] France ..... 92 05554

[51] Int. Cl.[6] ..... A44B 11/26

[52] U.S. Cl. ..... 24/616; 24/200; 24/265 BC

[58] Field of Search ..... 24/614–615, 24/625, 265 BC, 172, 197, 200, 616

[56] References Cited

U.S. PATENT DOCUMENTS 4,282,634 8/1981 Krauss ..... 24/616 X
4,901,373 2/1990 Broersma ..... 24/200 X

FOREIGN PATENT DOCUMENTS 8816545 7/1989 Germany .
WO89/01744 3/1989 WIPO .

*Primary Examiner*—James R. Brittain
*Attorney, Agent, or Firm*—Stevens, Davis, Miller & Mosher

[57] ABSTRACT

A fixing loop for a chin-strap of a safety helmet having a female retaining stud subdivided by an internal partition into two staggered compartments and a male clipping tab equipped with a locking spur, said tab being designed to be fitted into one of the compartments by passing through a slot. The other compartment permits V-shaped criss-crossing of a strap through other slots.

10 Claims, 9 Drawing Sheets

FIXING LOOP FOR A CHIN-STRAP OF A SAFETY HELMET

BACKGROUND OF THE INVENTION

The invention relates to a fixing loop, notably for a chin-strap of a safety helmet, comprising a male clipping means designed to be fitted into a female retaining means to form a mechanical connection with positive locking.

The document FR-A-2,665,340 describes a chin strap loop, in which the female part has a general V shape comprising a triangular middle part and two end parts. Each end part comprises grooves for engagement of a strap strand. The middle part is equipped with a recess cooperating with the retaining stud of the male part. Such a V-shaped loop structure means that large dimensions are imposed and requires the use of three strap strands, each strand being adjustable in length. Unlocking of the mechanical connection with clipping of the two male and female parts must be performed with both the user's hands, which may be awkward in some situations.

A first object of the invention consists in achieving a fixing loop for a chin-strap, with reduced dimensions and of simplified use for the locking and unlocking operations.

A second object of the invention consists in achieving a chin-strap loop using two strap strands

SUMMARY OF THE INVENTION

The loop according to the invention is characterized in that the female retaining means is arranged as a hollow stud subdivided by an internal separating partition into a staggered first and second compartments, that the male clipping means comprises a tab with locking spur designed to be inserted in the first compartment through a first slot, and that the second compartment is equipped with means for V-shaped criss-crossing of a strap passing through a second slot, said first and second slots being parallel and separated from one another by the partition.

The advantage resulting from such a loop structure makes possible the mechanical connection by clipping of the male and female means, and the V-shaped criss-crossing of a strap in two distinct staggered compartments inside the hollow stud. This results in reduced size which improves user convenience.

The second compartment is divided into two adjacent elementary chambers by a wall inclined with respect to the mid-plane of symmetry, said wall being appreciably perpendicular to the partition separating the two staggered compartments, and extending from one end of the second slot up to a spacer separating a third and a fourth slots respectively in communication with the first and second chambers.

The locking spur of the tab is flexible and comprises a catch cooperating with a fixed stop of the hollow stud when the spur moves to the active position in the orifice of the second surface when the tab reaches the end of insertion travel in the first compartment.

Unlocking of the loop is achieved by a manual pushing action on the spur to move it against the elastic force to an inactive position so as to release the catch from the locking effect of the stop. The unlocking action is thus performed with one hand.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

In the figures, a fixing loop 10, used notably for a chin-strap of a safety helmet, comprises a male clipping means 12 designed to pass through a first slot 14 and to engage in a female retaining means 16 to form a mechanical connection with positive locking.

Figure 3:
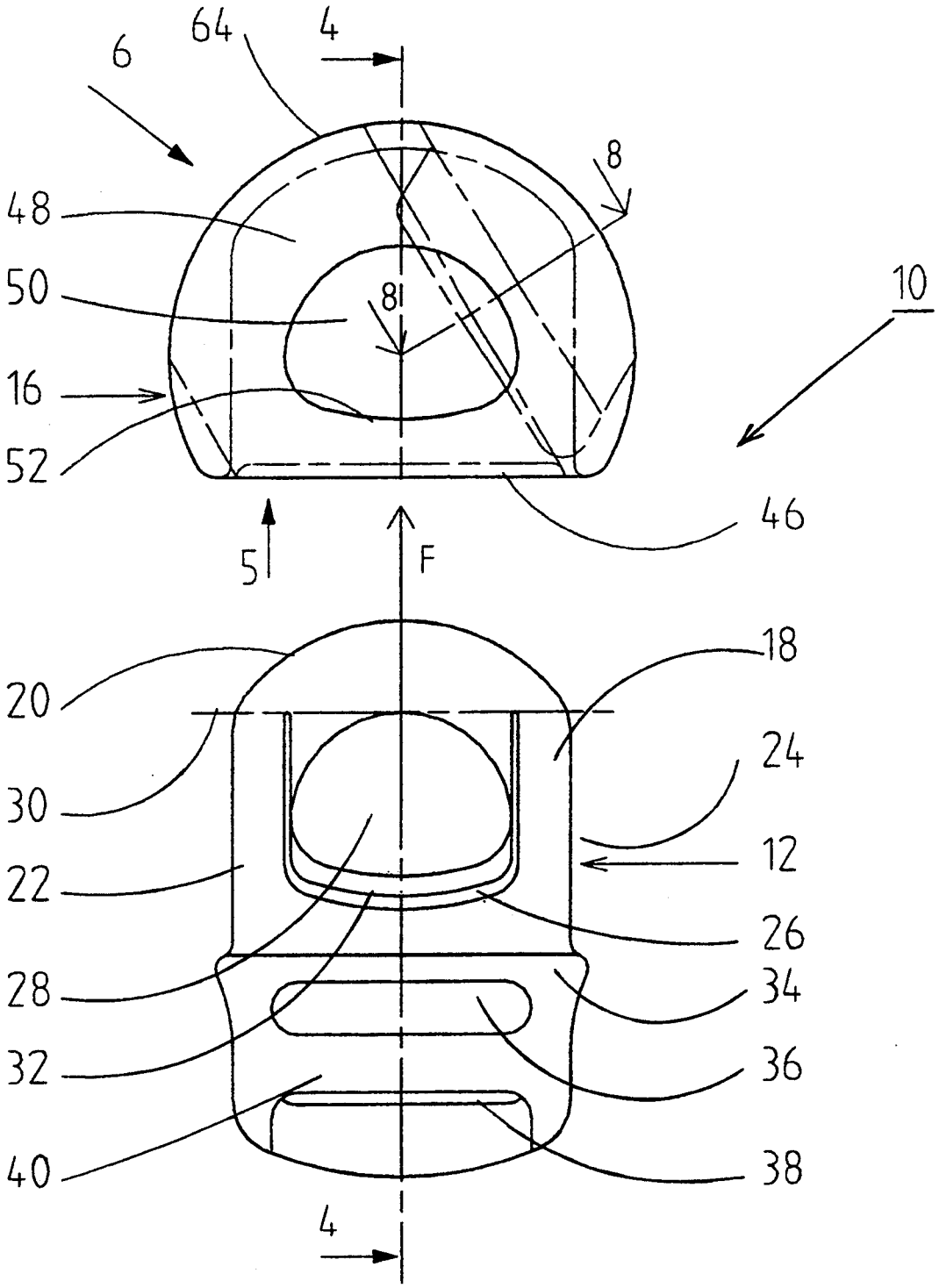
FIG. 3 is an identical view to FIG. 1 in the unlocking position of the male and female means.
Figure 4:
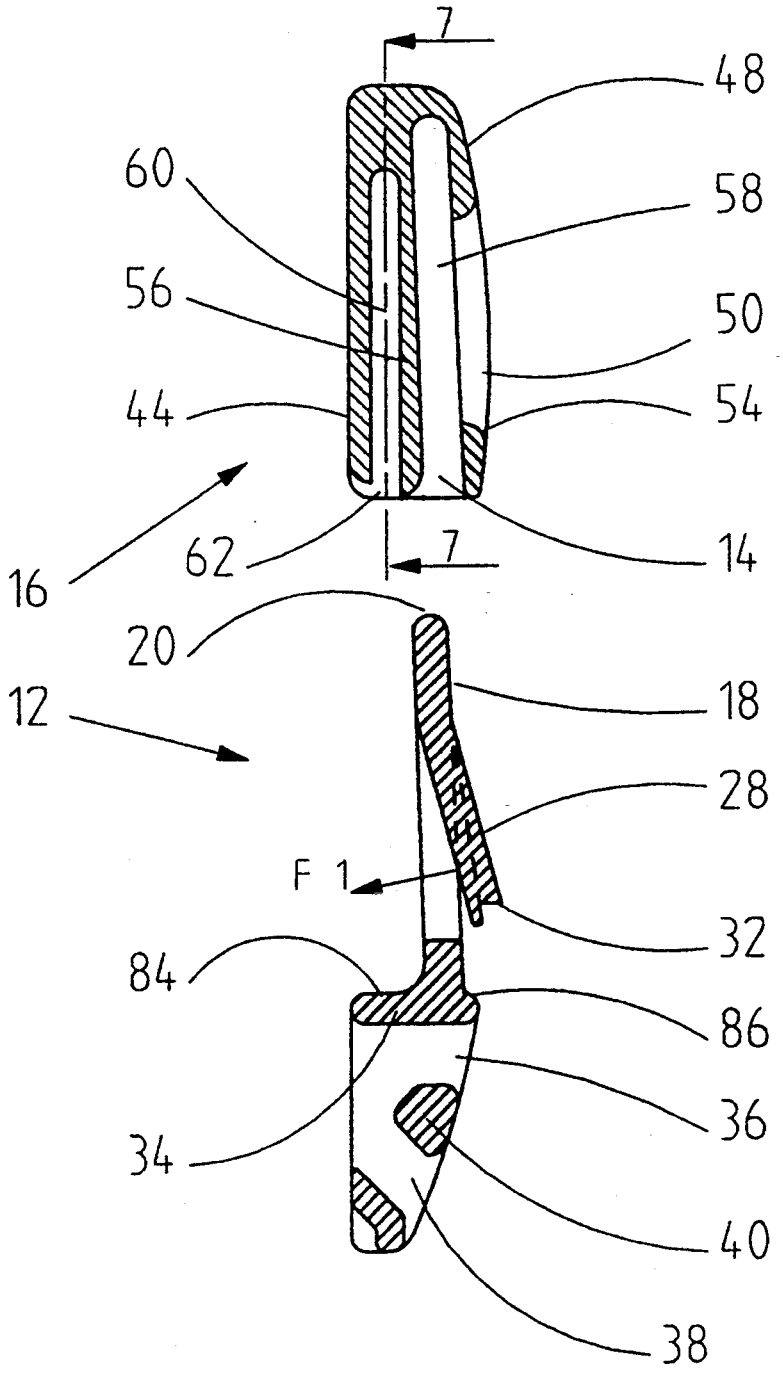
FIG. 4 represents a cross-sectional view according to the line 4—4 of FIG. 3.
Figure 5:
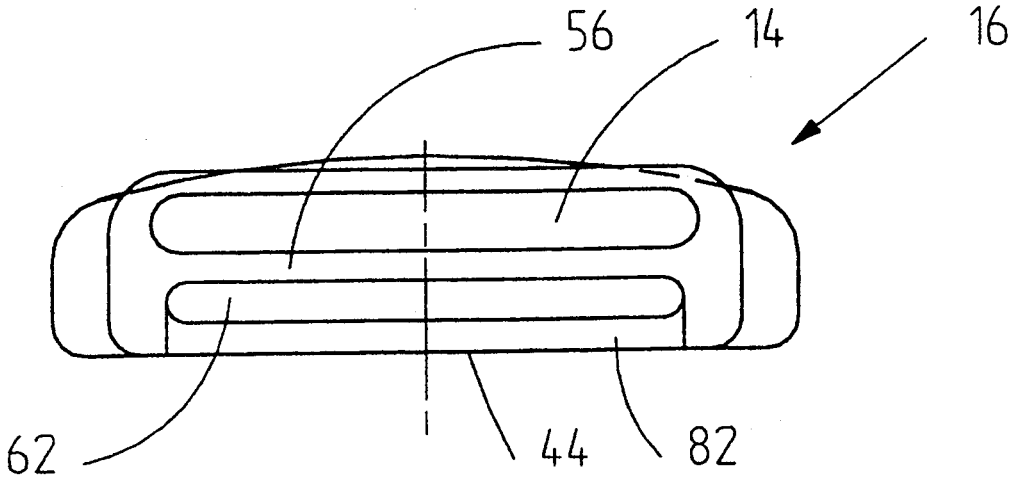
FIG. 5 is a view according to the arrow 5 of FIG. 3, showing the front surface of the female retaining part.
Figure 6:
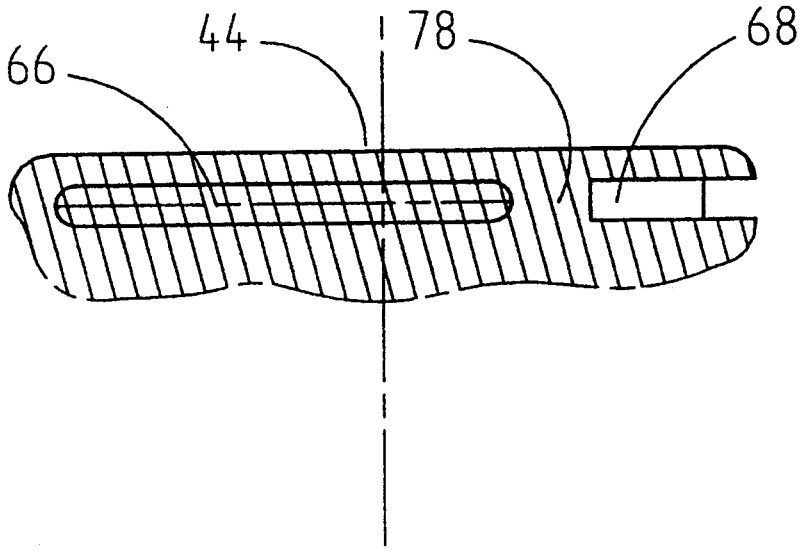
FIG. 6 represents a partial side view according to the arrow 6 of FIG. 3, showing the third and fourth slots of the bottom compartment.

The male clipping means 12 comprises an appreciably flat tab 18 having a rounded front edge 20 bounded by two opposite side edges 22, 24 extending parallel to the longitudinal engagement direction indicated by the arrow F (FIG. 3). A U-shaped groove 26 is cut out in the tab 18 so as to constitute a flexible locking spur 28 mounted with limited pivoting around a dummy transverse and perpendicular axis 30 in the longitudinal engagement direction F. The free end of the spur 28 is provided with a catch 32, and the elastic effect urges the spur 28 to protrude out from the top surface of the tab 18.

Figure 10:
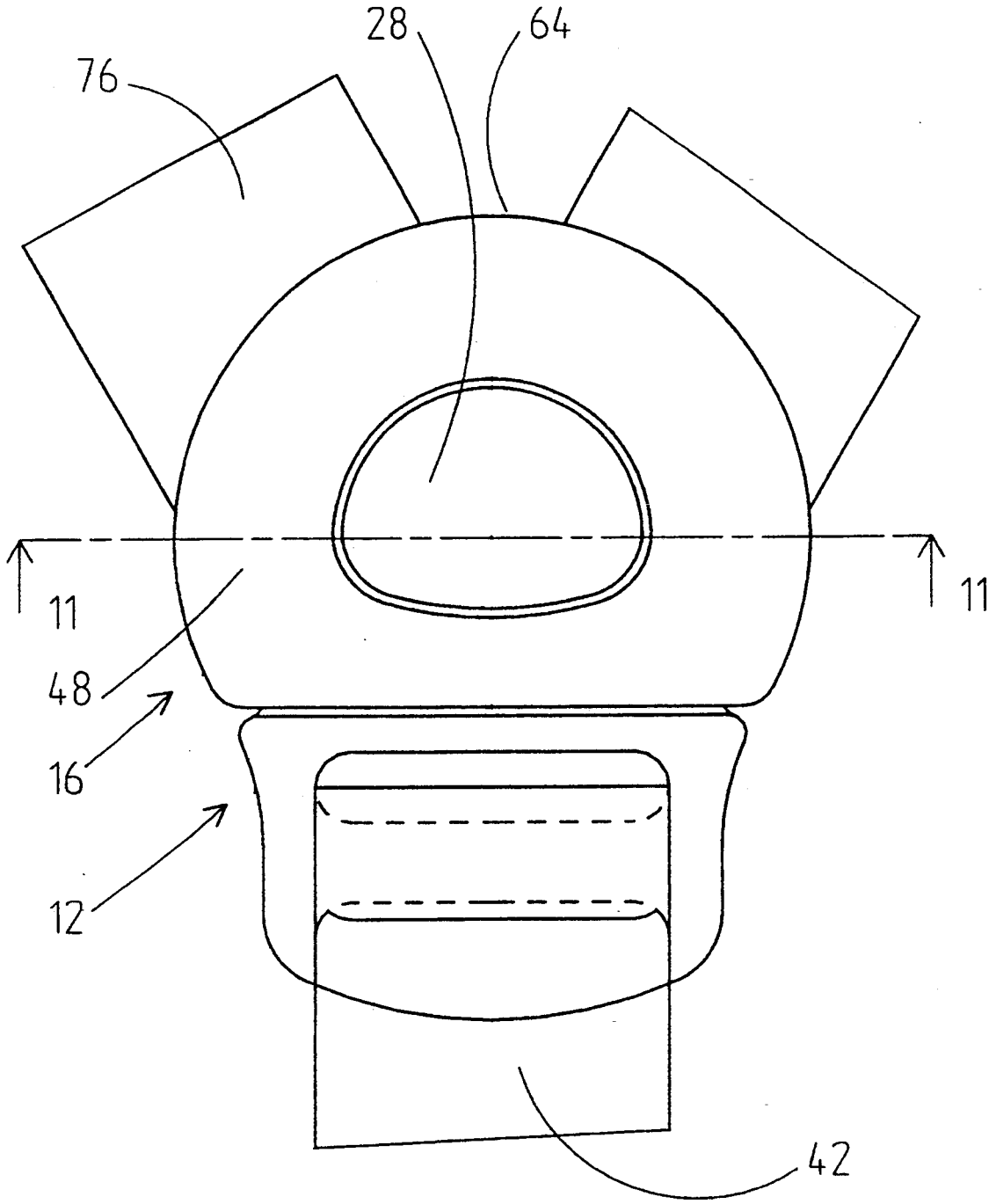
FIG. 10 is an identical view to FIG. 1 with fitting of the two strap strands.

The tab 18 of the male clipping means 12 is securedly united opposite from the edge 20 to a gripping base 34 provided with two grooves 36, 38 parallel to the dummy axis 30 and separated by a cross-piece 40, enabling a first chin-strap band 42 to pass with criss-crossing and length adjustment (FIG. 10).

Figure 1:
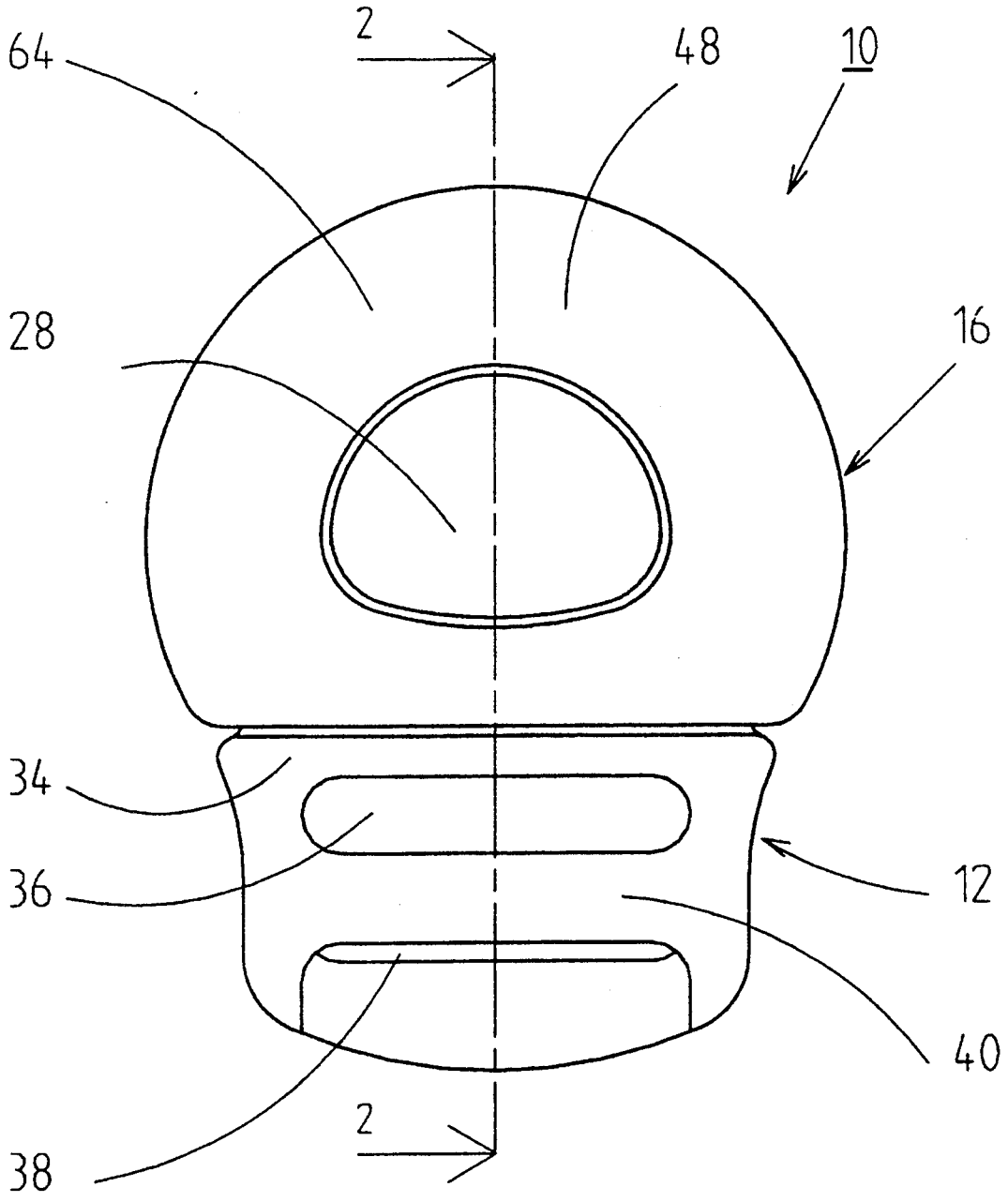
FIG. 1 is an elevational view of a fixing loop according to the invention, the male and female means being in the locked position.
Figure 2:
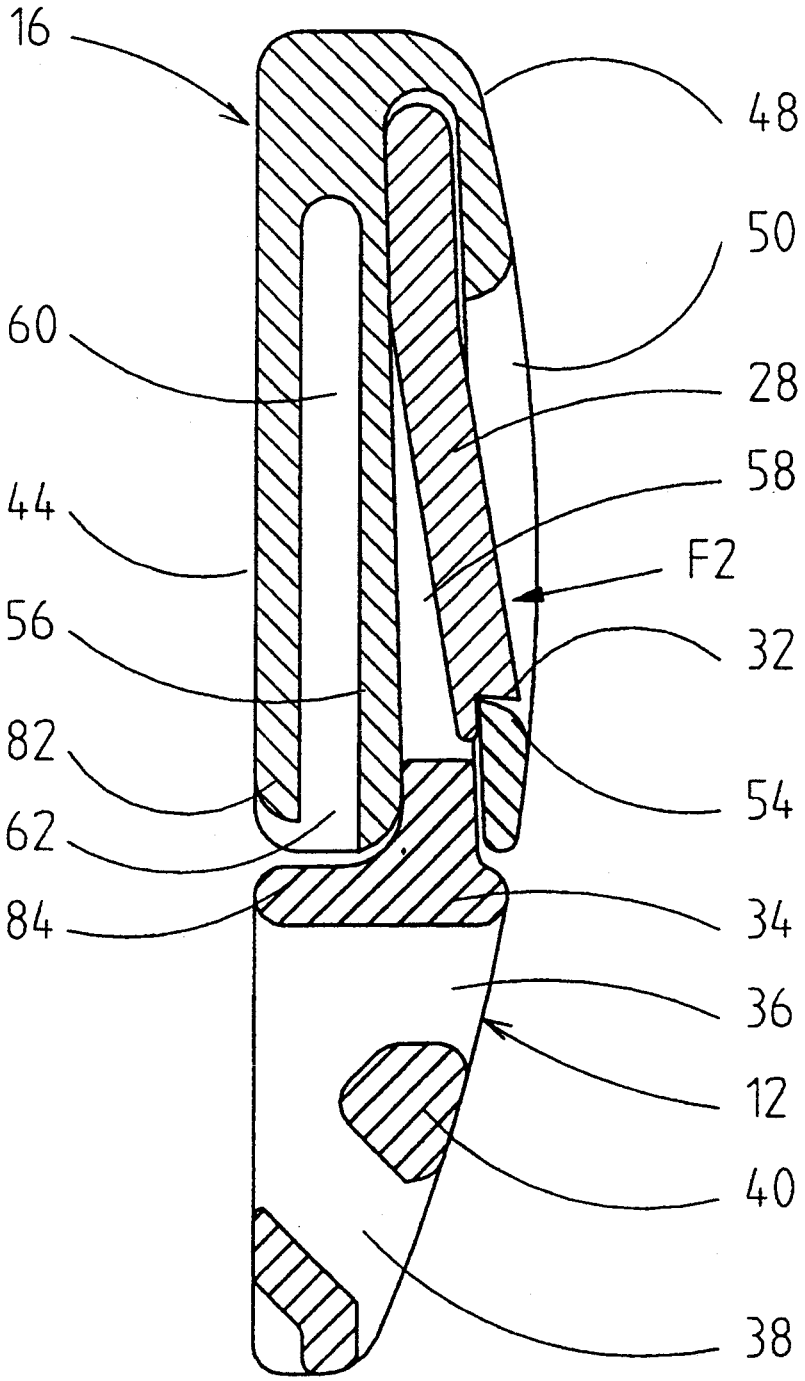
FIG. 2 shows a cross-sectional view according to the line 2—2 of FIG. 1.

The female retaining means 16 is arranged as a semi-circular hollow stud, having a flat base 44, and a first appreciably straight front surface 46 perpendicular to the base 44. A second top surface 48 of the stud is slightly rounded and comprises an orifice 50 of conjugate shape to that of the locking spur 28. The edge 52 of the orifice 50, located near the front surface 46, is provided with a stop 54 designed to cooperate with the catch 32 of the spur 28 in the locked position of the two parts 12, 16 of the loop 10 (see FIG. 2).

The internal space of the hollow stud is divided by an intermediate partition 56 into a staggered first and second compartments 58, 60. The separating partition 56 extends horizontally in a direction parallel to the base 44 up to the front surface 46 to bound the first slot 14 giving access to the top compartment 58, and a second slot 62 associated with the bottom compartment 60, the latter being arranged between the base 44 and partition 56. The two slots 14, 62 are parallel and superposed heightwise.

The base 44 is connected to the second rounded top surface 48 of the stud by a third semi-cylindrical lateral surface 64 equipped with a third and a fourth slots 66, 68 coplanar with the second slot 62.

Figure 7:
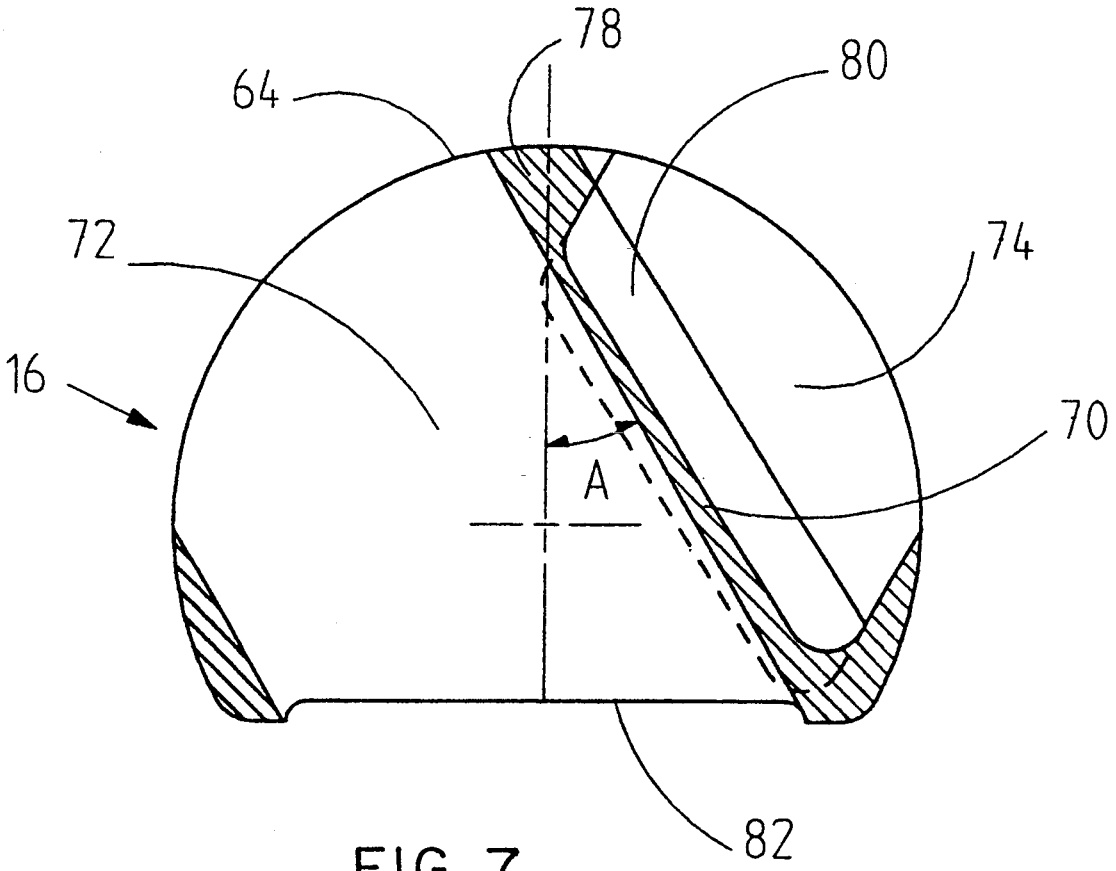
FIG. 7 partial cross-sectional view according to the line 7—7 of FIG. 4, showing the two adjacent chambers of the bottom compartment.
Figure 8:
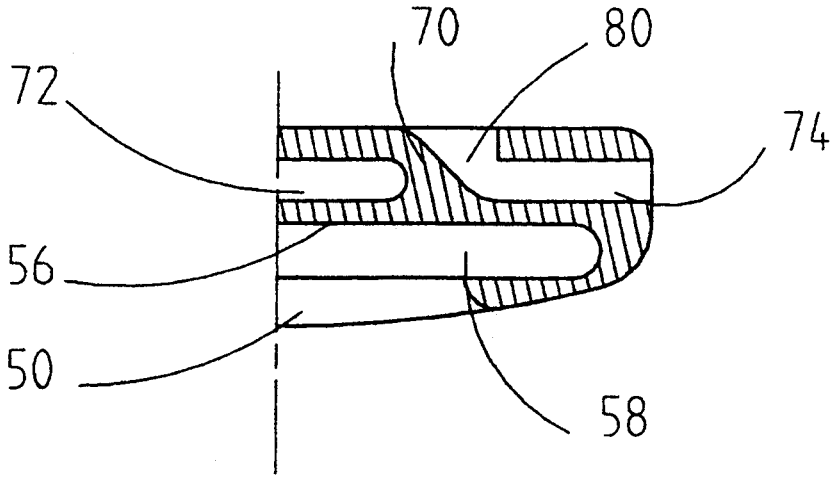
FIG. 8 is a partial cross-sectional view according to the line 8—8 of FIG. 3.
Figure 9:
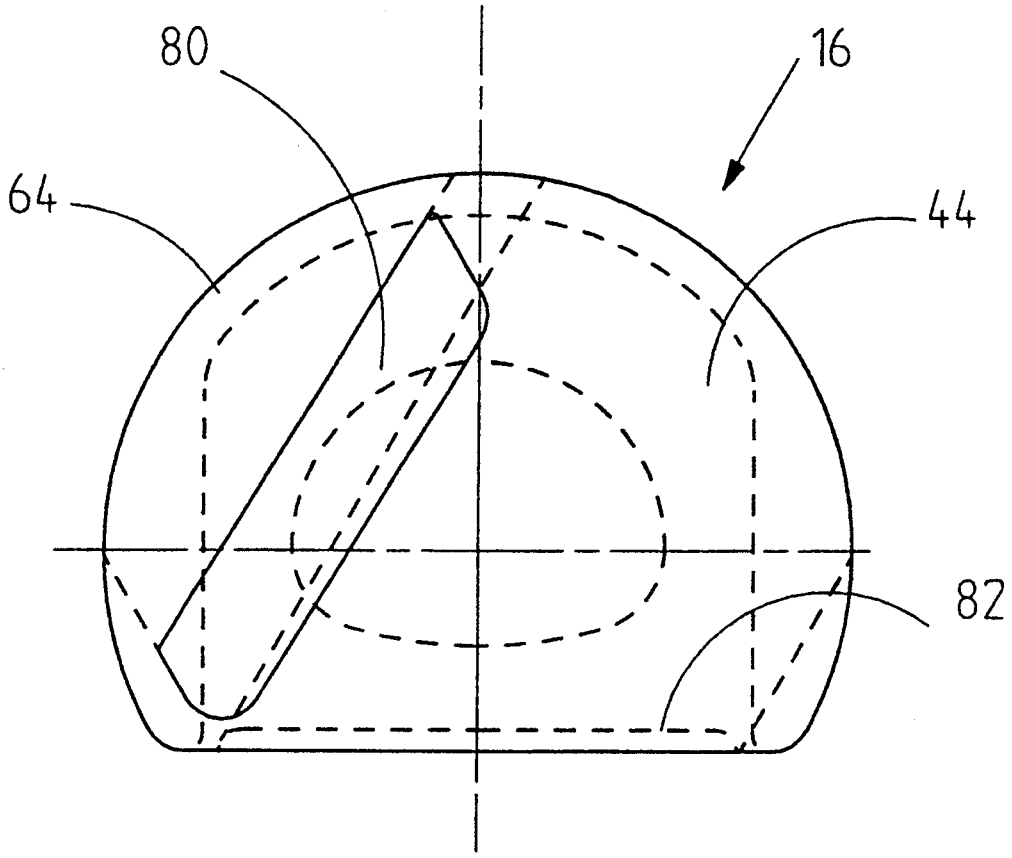
FIG. 9 represents a view of the bottom after the female retaining part according to FIG. 3 has been turned round.

The bottom compartment 60 of the retaining means 16 is itself subdivided by a vertical wall 70 into two adjacent chambers 72, 74 allowing V-shaped criss-crossing of a second band 76 or strap of the chin-strap (FIG. 10). The wall 70 is inclined by an acute angle A with respect to the mid-plane of symmetry, extending continuously from the right-hand end of the second slot 62 up to a spacer 78 separating the third and fourth slots 66, 68 (FIG. 7).

The base 44 is provided with a fifth slot 80 giving access to the chamber 74, said slot 80 extending close to the wall 70 and along the same inclined direction.

The wall 82 of the base 44 bounding the second slot 62 allowing access to the chamber 72 is slightly set back with respect to the partition 56.

The two clipping and retaining means 12, 16 are achieved by molding of a plastic material having a high mechanical strength. The gripping base 34 of the clipping means 12 comprises a bottom shoulder 84 and a top edge 86 designed to come into engagement against the first front surface 46 at the end of insertion travel of the male clipping means 12 into the female retaining means 16. The thickness of the three slots 62, 66, 68 of the bottom compartment 60 is slightly greater than that of the strap 76.

Figure 11:
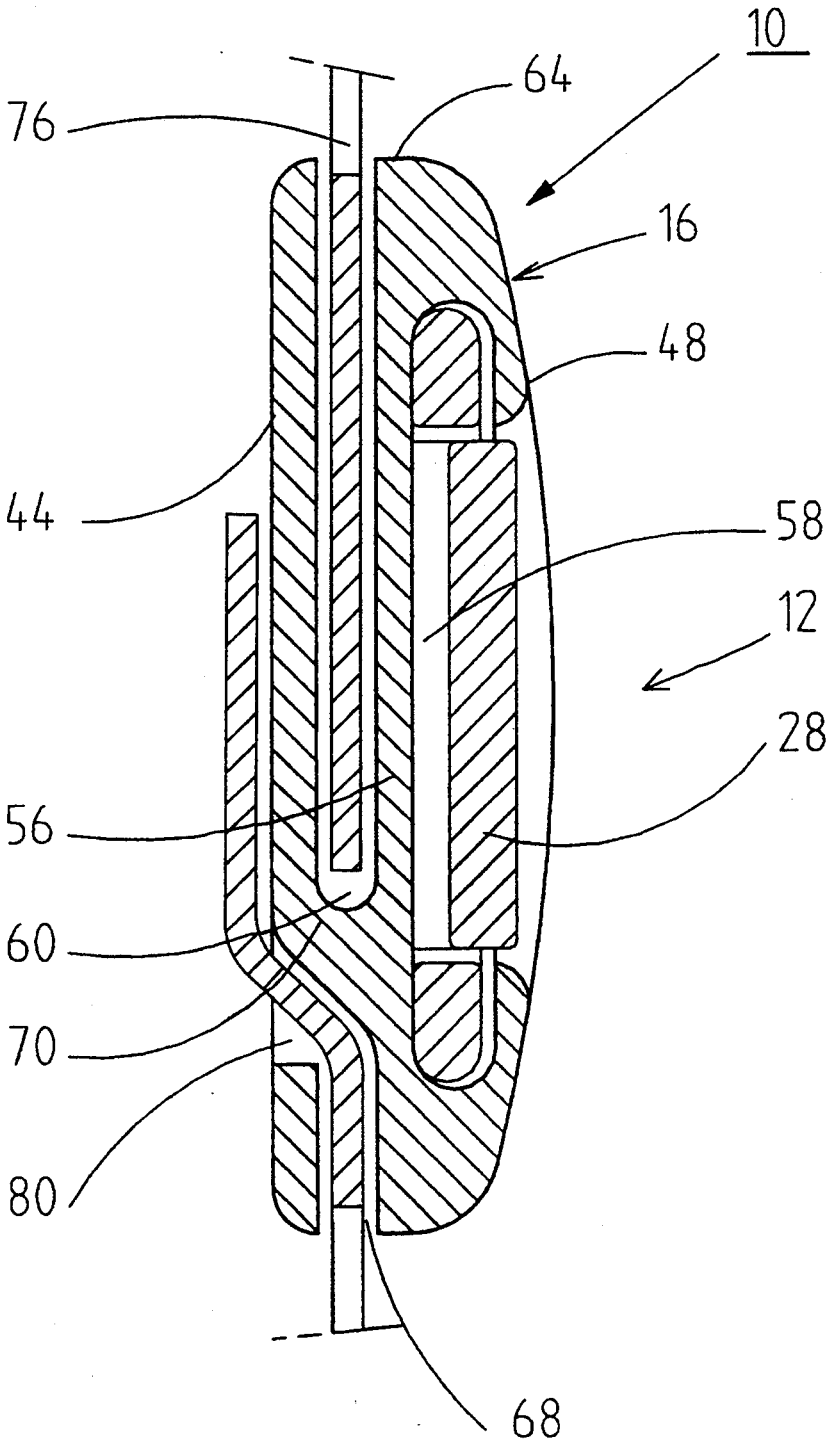
FIG. 11 is a cross-sectional view according to the line 11—11 of FIG. 10.

The use of the fixing loop 10 according to the invention is as follows:

The female retaining means 16 is joined to one of the sides of the helmet (not represented) by the two strands of the second strap 76. The latter is previously fitted in the two chambers 72, 74 of the bottom compartment 60 of the hollow stud. The end of the strap 76 is first inserted via the rear into the chamber 72 through the third slot 66 (according to the arrow 6 indicated in FIG. 3), then comes out at the front through the second slot 62, followed by total folding through 180 degrees under the external face of the base 44. To achieve the V-shaped crisscrossing of the strap 76 in the bottom compartment 60, the strap 76 is then reinserted into the adjacent chamber 74 through the fifth slot 80 of the base 44, and then comes out from said chamber 74 through the fourth slot 68 (see FIG. 11). The second strap 76 is inserted and extracted on the side of the third lateral surface 64, and the V-shape is ensured by the multidirectional folding of the strap inside the hollow stud.

The first strap 42 is also fitted in the two grooves 36, 38 of the gripping base 34 of the male clipping means 12. The useful length of the strap 42 can be adjusted according to the morphology of the user.

Closing of the loop 10 is achieved by inserting the tab 18 of the male clipping means 12 according to the arrow F (FIG. 3) in the top compartment 58 of the female retaining means 16. The height of the top compartment 58 is slightly greater than the thickness of the tab 18, and the latter has a shape conjugate to the longitudinal cross-section of the compartment 58. In the course of the insertion movement of the tab 18 through the first slot 14, the flexible spur 28 is folded down in the direction of the arrow F1 to an inactive position until the front edge 20 comes up against the bottom of the compartment 58. The flexible spur 28 is then urged in the opposite direction to the active position inside the orifice 50 of the second top surface 48.

The catch 32 of the spur 28 comes into contact with the stop 54 of the edge 52, preventing any retraction of the male clipping means 12, which finds itself locked inside the top compartment 58. The gap separating the wall 82 from the shoulder 84 in the locked position of the loop 10 enables the strap 76 to pass at the level of the second slot 62.

Unlocking of the loop 10 is performed by a manual pushing action on the spur 28 (see arrow F2 in FIG. 2), which is moved against the elastic force to the inactive position, releasing the catch 32 from the locking effect of the stop 54. The tab 18 can then be removed from the top compartment 58 to achieve the physical separation of the two means 12, 16 of the fixing loop 10.

The mechanical connection by clipping of the two means 12, 16 of the loop 10, and the V-shaped criss-crossing of the second strap 76 are performed in two distinct compartments 58, 60 staggered inside the hollow stud of the female retaining means 16. The fixing loop 10 of the chin-strap thereby has smaller overall dimensions and improves the comfort and convenience of the user.

We claim:

1. A fixing loop for a chin-strap of a safety helmet, comprising:

a male clipping means designed to be fitted into a female retaining means to form a mechanical connection with positive locking, said female retaining means being arranged as a hollow stud subdivided by an internal separating partition into a staggered first and second compartments, a tab of the male clipping means having a locking spur designed to be inserted in the first compartment through a first slot, criss-crossing means being located in the second compartment for the V-shaped passage of a strap passing through a second slot, said first and second slots extending parallel to one another being separated by said internal partition.

2. The fixing loop according to claim 1, wherein the second compartment is divided into two adjacent elementary chambers by a wall inclined with respect to the mid-plane of symmetry, said wall being appreciably perpendicular to the partition separating the two staggered compartments, and extending from one end of the second slot up to a spacer separating a third and a fourth slots respectively in communication with the first and second chambers.

3. The fixing loop according to claim 2, wherein the hollow stud of the female retaining means comprises a flat bottom parallel to the separating partition, a first front surface perpendicular to the partition at the level of the first and second slots, a second surface opposite the bottom having an orifice of conjugate shape to that of the locking spur of the tab, and a third lateral surface joining the bottom to the first and second surfaces, the third and fourth slots being arranged along the third lateral surface, on each side of the spacer, and the bottom being provided with a fifth slot giving access to the second chamber.

4. The fixing loop according to claim 3, wherein the second, third and fourth slots are appreciably coplanar at the level of the second compartment, and the wall of the bottom bounding the second slot giving access to the first chamber is located slightly set back with respect to the longitudinal position of the separating partition.

5. The fixing loop according to claim 3, wherein the locking spur of the tab is flexible and comprises a catch cooperating with a fixed stop on the hollow stud when the spur moves to a locking position in the orifice of the second surface after the tab reaches the end of insertion travel in the first compartment.

6. The fixing loop according to claim 5, wherein the stop is formed by an edge of the orifice, and unlocking of the loop is achieved by a manual pushing action on the spur to move the spur against an elastic force of the spur to an inactive position so as to release the catch from the locking effect of the stop.

7. The fixing loop according to claim 3, wherein the fifth slot passes through the bottom, and extends close to the wall and along the same inclined direction.

8. The fixing loop according to claim 3, wherein the tab of the male clipping means is securedly united to a gripping base having grooves for adjustable fitting of a strap, and the base comprises stopping means designed to come into engagement against the first front surface at the end of insertion travel of the tab in the first compartment.

9. The fixing loop according to claim 1, wherein the flexible locking spur is achieved by cut-out of a U-shaped groove in a flat tab, and the front edge of the tab is rounded being bounded between two opposite side edges extending parallel to the longitudinal engagement direction.

10. The fixing loop according to claim 1, wherein the clipping means and retaining means are obtained by molding of a plastic material of high mechanical strength.

* * * * *